US005515336A

United States Patent [19]

Chin et al.

[11] Patent Number: 5,515,336

[45] Date of Patent: May 7, 1996

[54] MWD SURFACE SIGNAL DETECTOR HAVING BYPASS LOOP ACOUSTIC DETECTION MEANS

[75] Inventors: Wilson C. Chin; Wallace R. Gardner; Margaret C. Waid, all of Houston, Tex.

[73] Assignee: Halliburton Company, Dallas, Tex.

[21] Appl. No.: 292,100

[22] Filed: Aug. 17, 1994

[51] Int. Cl.[6] ..... E21B 47/06

[52] U.S. Cl. ..... 367/83; 175/48

[58] Field of Search ..... 367/83, 84, 85; 175/40, 48, 50; 166/250

[56] References Cited

U.S. PATENT DOCUMENTS

| | | | |
|---|---|---|---|
| 3,302,457 | 2/1967 | Mayes | 367/83 |
| 3,488,629 | 1/1970 | Claycomb | 367/83 |
| 3,555,504 | 1/1971 | Fields | 367/83 |
| 3,595,075 | 7/1971 | Dower | 175/48 |
| 3,784,822 | 1/1974 | Schuster | 250/260 |
| 3,949,354 | 4/1976 | Claycomb | 340/18 |
| 3,958,217 | 5/1976 | Spinnler | 340/18 |
| 3,964,556 | 6/1976 | Gearhart et al. | 175/45 |
| 4,047,027 | 9/1977 | Bateman et al. | 250/264 |
| 4,129,777 | 12/1978 | Wahl et al. | 250/264 |
| 4,152,545 | 5/1979 | Gilbreath et al. | 179/1.5 |
| 4,216,536 | 8/1980 | More | 367/83 |
| 4,401,134 | 8/1983 | Dailey | 137/624 |
| 4,511,843 | 4/1985 | Thoraval | 324/338 |
| 4,515,225 | 5/1985 | Dailey | 175/40 |
| 4,596,926 | 6/1986 | Coope | 250/265 |
| 4,661,933 | 4/1987 | Seeman et al. | 367/27 |
| 4,665,511 | 5/1987 | Rodney et al. | 367/35 |
| 4,736,204 | 4/1988 | Davison | 340/856 |
| 4,791,797 | 12/1988 | Paske et al. | 73/152 |
| 4,794,792 | 1/1989 | Flaum et al. | 73/152 |
| 4,864,129 | 9/1989 | Paske et al. | 250/269 |
| 5,006,845 | 4/1991 | Calcar et al. | 175/48 |
| 5,091,644 | 2/1992 | Minette | 250/254 |
| 5,130,950 | 7/1992 | Orban et al. | 367/34 |
| 5,159,577 | 10/1992 | Twist | 367/25 |
| 5,175,429 | 12/1992 | Hall, Jr. et al. | 250/262 |
| 5,214,251 | 5/1993 | Orban et al. | 181/102 |

FOREIGN PATENT DOCUMENTS 2252623 8/1992 United Kingdom .

OTHER PUBLICATIONS

"Neutron Porosity Measurement While Drilling," by Michael L. Gartner, IEEE Transactions on Nuclear Science, vol. 35, No. 1, Feb. 1988.

"Introduction to Petroleum Production," vol. 1, D. R. Skinner, Chapter 2, 3, 4.

IADC/SPE 14764; "Predicting Bottomhole Assembly Performance," by J. S. Williamson and A. Lubinski.

*Primary Examiner*—Charles T. Jordan
*Assistant Examiner*—Christopher K. Montgomery
*Attorney, Agent, or Firm*—Conley, Rose & Tayon

[57] ABSTRACT

An acoustic detector in a mud pulse telemetry system includes a bypass loop in parallel with a section of the main mud line that supplies drilling mud to a drill string. The detector includes a pair of pressure sensing ports in the bypass line, and one or more pressure transducers for detecting the pressure at different locations in the bypass loop so that the differential pressure can be measured. The bypass loop has a small internal passageway relative to the main mud supply line and may include a constriction so as to create two regions in the passageway that differ in cross sectional areas. Forming the pressure sensing ports in the regions of differing cross sectional areas allows the pressure transducers to more precisely detect the mud pulse signals. Because of its relatively small cross sectional area, only a small fraction of the drilling mud flows through the bypass loop. The bypass loop may thus be constructed of hydraulic hose and a relatively small rigid body having a central through bore.

18 Claims, 3 Drawing Sheets

MWD SURFACE SIGNAL DETECTOR HAVING BYPASS LOOP ACOUSTIC DETECTION MEANS

BACKGROUND OF THE INVENTION

The present invention relates generally to the field of telemetry systems for transmitting information through a flowing stream of fluid. More particularly, the invention relates to the field of mud pulse telemetry where information detected at the bottom of a well bore is transmitted to the surface by means of pressure pulses created in the mud stream that is circulating through the drill string. Still more particularly, the invention relates to an acoustic signal detector that senses the pressure pulses in a bypass loop outside the main mud supply line.

Drilling oil and gas wells is carried out by means of a string of drill pipes connected together so as to form a drill string. Connected to the lower end of the drill string is a drill bit. The bit is rotated and drilling accomplished by either rotating the drill string, or by use of a downhole motor near the drill bit, or by both methods. Drilling fluid, termed mud, is pumped down through the drill string at high pressures and volumes (such as 3000 p.s.i. at flow rates of up to 1400 gallons per minute) to emerge through nozzles or jets in the drill bit. The mud then travels back up the hole via the annulus formed between the exterior of the drill string and the wall of the borehole. On the surface, the drilling mud is cleaned and then recirculated. The drilling mud is used to cool the drill bit, to carry chippings from the base of the bore to the surface, and to balance the hydrostatic pressure in the rock formations.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other down hole parameters, such as the temperature and the pressure at the base of the borehole, as examples. Once these data are gathered at the bottom of the bore hole, it is typically transmitted to the surface for use and analysis by the driller.

One prior art method of obtaining at the surface the data taken at the bottom of the borehole is to withdraw the drill string from the hole, and to lower the appropriate instrumentation down the hole by means of a wire cable. Using such "wireline" apparatus, the relevant data may be transmitted to the surface via communication wires or cables that are lowered with the instrumentation. Alternatively, the instrumentation may include an electronic memory such that the relevant information may be encoded in the memory to be read when the instrumentation is subsequently raised to the surface. Among the disadvantages of these wireline methods are the considerable time, effort and expense involved in withdrawing and replacing the drill string, which may be, for example, many thousands of feet in length. Furthermore, updated information on the drilling parameters is not available while drilling is in progress when using wireline techniques.

A much-favored alternative is to employ sensors or transducers positioned at the lower end of the drill string which, while drilling is in progress, continuously or intermittently monitor predetermined drilling parameters and formation data and transmit the information to a surface detector by some form of telemetry. Such techniques are termed "measurement while drilling" or MWD. MWD results in a major savings in drilling time and cost compared to the wireline methods described above.

Typically, the down hole sensors employed in MWD applications are positioned in a cylindrical drill collar that is positioned close to the drill bit. The MWD system then employs a system of telemetry in which the data acquired by the sensors is transmitted to a receiver located on the surface. There are a number of telemetry systems in the prior art which seek to transmit information regarding downhole parameters up to the surface without requiring the use of a wireline tool. Of these, the mud pulse system is one of the most widely used telemetry systems for MWD applications.

The mud pulse system of telemetry creates acoustic signals in the drilling fluid that is circulated under pressure through the drill string during drilling operations. The information that is acquired by the downhole sensors is transmitted by suitably timing the formation of pressure pulses in the mud stream. The information is received and decoded by a pressure transducer and computer at the surface.

In a mud pressure pulse system, the drilling mud pressure in the drill string is modulated by means of a valve and control mechanism, generally termed a pulser or mud pulser. The pulser is usually mounted in a specially adapted drill collar positioned above the drill bit. The generated pressure pulse travels up the mud column inside the drill string at or near the velocity of sound in the mud. Depending on the type of drilling fluid used, the velocity may vary between approximately 3000 and 5000 feet per second. The rate of transmission of data, however, is relatively slow due to pulse spreading, modulation rate limitations, and other disruptive forces, such as the ambient noise in the drill string. A typical data bit rate is on the order of a bit per second. Some present day systems operate at higher frequencies, for example, 3 bits per second, and up to 10 bits per second with data compression. Representative examples of mud pulse telemetry systems may be found in U.S. Pat. Nos. 3,949,354, 3,958,217, 4,216,536, 4,401,134, and 4,515,225.

Mud pressure pulses can be generated by a number of known means which operate downhole to momentarily divert or restrict the mud flow. Without regard to the type of pulse generation employed, detection of the pulses at the surface is sometimes difficult due to attenuation of the signal and the presence of noise generated by the mud pumps, the downhole mud motor and elsewhere in the drilling system. Present day detectors employ one or more pressure transducers to detect the mud pulses. The transducers detect variations in the drilling mud pressure at the surface and generate electrical signals responsive these pressure variations. The pressure transducer is typically mounted directly on the line or standpipe that is used to supply the drilling fluid to the drill string. An access port or tapping is formed in the pipe, and the transducer is threaded into the port. With some types of transducers, a portion of the device extends into the stream of flowing mud where it is subject to wear and damage as a result of the abrasive nature and high velocity of the drilling fluid.

In another present day apparatus for detecting pressure pulses, the internal fluid passageway in the mud supply line is constricted at a particular location such that the drilling fluid must pass through adjacent regions having different cross sectional areas. This is accomplished by cutting and removing a segment of the supply line at the predetermined location. The removed section of pipe, which typically may be 8 inch diameter rigid metal pipe approximately 24 inches long, is then replaced with a generally tubular body that has been machined to include the desired reduced area portion. The body of such a detector includes a through bore for conducting the drilling fluid and typically has an outside diameter approximately the same size as the piping comprising the mud supply line. The body further includes an access port into the internal passageway at each of the regions of differing cross sectional areas. The body is welded into the supply line in place of the removed pipe segment, and each of the ports is then interconnected by a conduit to a different input port of a differential pressure transducer. The acoustic signal carded by the flowing drilling mud induces an added velocity component to the drilling mud passing through the body. The venturi effect produced in the mud by the constriction in the flow line amplifies the pulsing acoustic velocity signal, and the increased pressure signal is detected by the differential pressure transducer. While the use of venturi effects in obtaining steady flow rates from steady differential pressure measurements is known, the extrapolation of transient, compressible signals from similar measurements is not. Also, because this detector measures differential and not absolute pressure, it is relatively insensitive to many of the common sources of extraneous pressure pulses or "noise" that may arise during drilling by, for example, the drill bit becoming stuck and unstuck, or slipping and sliding in the hole.

While a detector using a differential pressure transducer and the in-line flow constrictor described above has proven useful in certain applications, the detector has certain inherent disadvantages. First, the flow constrictor adds additional power requirements due to the fact that the same volume of mud must now be pumped through the constriction. Further, the in-line constrictor body is heavy and cumbersome to transport and install. The installation requires that the mud supply line be cut in two places, and that the constrictor body then be welded in place. These procedures often prove difficult and time consuming. The difficulties are compounded when the procedures must be carried out under adverse weather conditions.

Additionally, because the body is installed "in-line," it carries the full flow of drilling mud, which frequently includes abrasive materials. The resulting erosion inside the constrictor body may require that the body be replaced periodically. Changing out the body is as complicated and time consuming as the original installation. In an attempt to lengthen the useful life of the constrictor body, a special hardfacing material has sometimes been applied to the internal surfaces of the body to reduce erosion and delay replacement. Such special treatment, however, adds significant expense to the manufacturing cost such a detector.

Thus, while it is advantageous to obtain information regarding the operating parameters and environmental conditions of the drill bit and motor using a flow constrictor and differential pressure transducer as described, there remains a need in the art for a detector that is insensitive to many of the extraneous pressure signals generated during drilling operations and, at the same time, does not require the same invasive and difficult procedures for installation. Preferably, the detector would be relatively small and light weight, easily transported and simple to install. Ideally, the detector components would operate outside of the main mud flow path, and thus would not require that expensive hardfacing materials be used in their manufacture.

SUMMARY OF THE INVENTION

Accordingly, there is provided herein an acoustic signal detector and method for detecting mud pulses transmitted in a drilling fluid supply line. The detector includes a bypass loop that is connected in parallel with a segment of the supply line. The bypass loop is of relatively small diameter in comparison to the supply line. The detector further includes a pair of pressure sensing ports in the bypass loop, and a means for detecting the fluid pressure at the pressure sensing ports and comparing those pressures.

The bypass loop may include a region of reduced cross sectional area relative to other regions in the loop. One of the pressure sensing ports intersects the reduced area region and the other port is located in and intersects a different region of the bypass loop. The pressures sensed at these different regions can be conveniently compared, as with a differential pressure transducer for example, to provide an accurate pressure pulse detector.

The bypass loop may include a generally tubular body having a fluid passageway that is interconnected with the drilling fluid supply line by commonly available hydraulic hoses. The passageway in the body includes a first region having a first cross sectional area, as well as the region of reduced cross sectional area. In this embodiment, a pair of bores are formed in the body, each of the bores forming one of the pressure sensing ports and intersecting a region of different cross sectional area. The bore intersecting the region of reduced cross sectional area is smaller in diameter than the other bore. To minimize erosion inside the body, the passageway may further include a tapered region disposed between the first region and the region of reduced area.

In addition, the invention includes a convenient and low cost method for detecting an acoustic mud pulse signal in drilling fluid. The method includes the steps of providing a pair of access ports in the drilling mud supply line and connecting a bypass loop therebetween. A constriction is placed in the loop, and the pressure of the drilling fluid at the constriction is compared with the pressure measured elsewhere in the bypass loop.

The present invention provides an acoustic signal detector and method for receiving mud pulse telemetry wherein the detector is relatively insensitive to much of the noise that is generated in the mud system and, at the same time, is easy to install and may be interconnected with the mud supply system without cutting the mud supply line or performing other such highly invasive procedures with respect to the supply line. The detector is relatively small and may be constructed of readily available components. It operates outside of the main mud flow where it is not exposed to excessive abrasion.

Thus, the present invention comprises a combination of features and advantages which enable it to substantially advance the art of mud pulse telemetry by providing a method and apparatus for accurately detecting mud pulse signals, and for substantially simplifying detector manufacture and installation. These and various other characteristics and advantages of the present invention will be readily apparent to those skilled in the art upon reading the following detailed description and referring to the accompanying drawings.

BRIEF DESCRIPTION OF THE DRAWINGS

For a detailed description of the preferred embodiment of the invention, reference will be made now to the accompanying drawings, wherein.

DETAILED DESCRIPTION OF THE PREFERRED EMBODIMENTS

Figure 1:
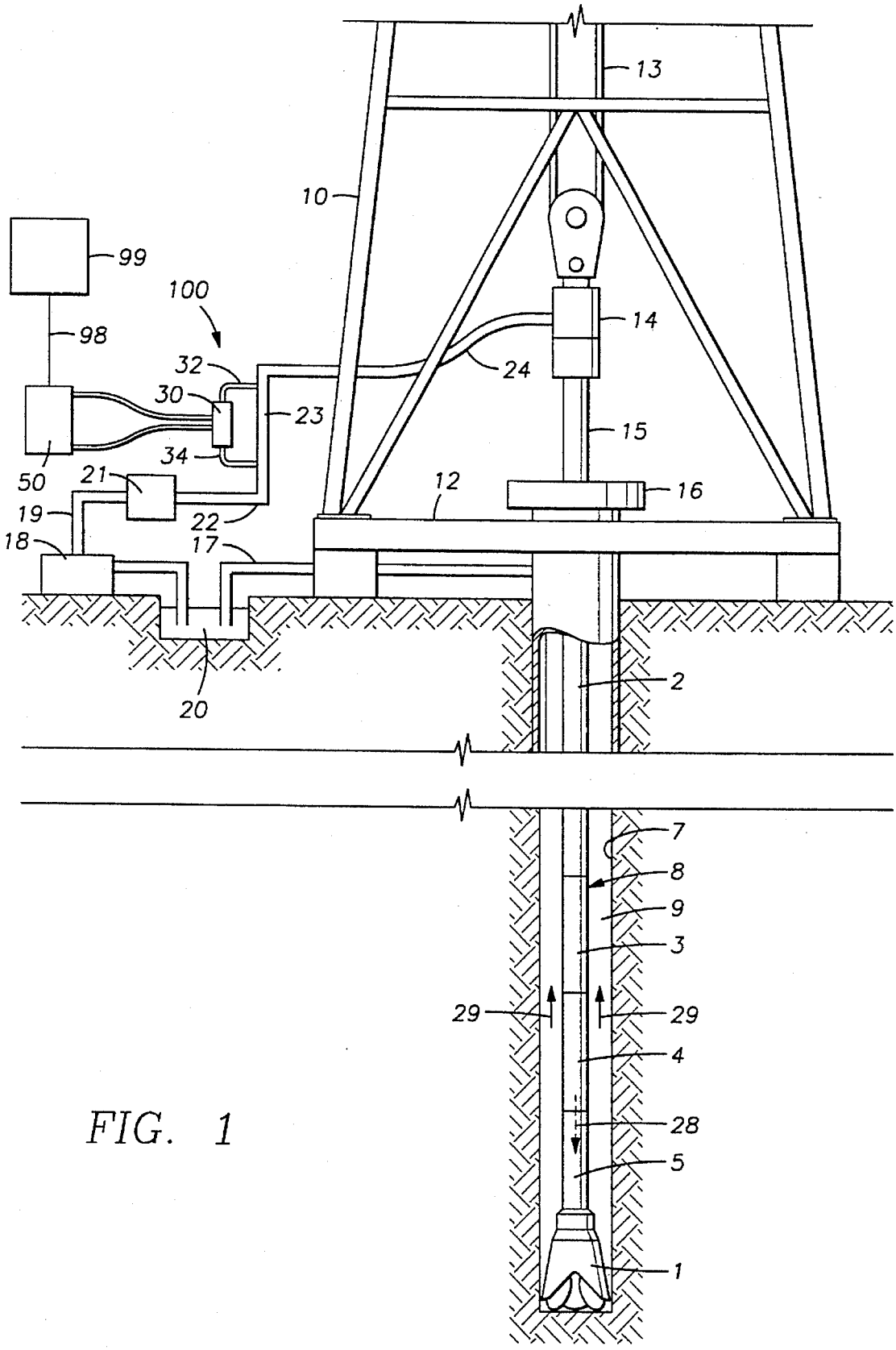
FIG. 1 is a schematic view, partly in cross section, of an oil well drilling and mud pulse telemetry system employing the signal detection apparatus of the present invention.

FIG. 1 depicts a well drilling system configured for MWD operation and having a mud pulse telemetry system for orienting and monitoring the drilling progress of a drill bit 1 and mud motor 5. A drilling derrick 10 is shown and includes a derrick floor 12, draw works 13, swivel 14, kelly joint 15, rotary table 16 and drill string 8. Derrick 10 is connected to and supplies tension and reaction torque for drill string 8. Drill string 8 includes a mud motor 5, drill pipe 2, standard drill collars 3 (only one of which is shown), a mud pulser subassembly 4, and drill bit 1. A conventional mud pump 18 pumps drilling mud out of a mud pit 20 through conduit 19 to the desurger 21. From desurger 21, the mud is pumped through stand pipe 22 and the rest of mud supply line 24 into the interior of the drill string 8 through swivel 14. As well understood by those skilled in the art, the interior of the drill string 8 is generally tubular, allowing the mud to flow down through the drill string 8 as represented by arrow 28, exiting through jets (not shown) formed in drill bit 1. After exiting the drill string 8, the mud is recirculated back upward along the annulus 9 that is formed between the drill string 8 and the wall of the borehole 7 as represented by arrows 29, where the mud returns to the mud pit 20 through pipe 17.

Although not shown in FIG. 1, the drill string 8 also includes a number of conventional sensing and detection devices for sensing and measuring a variety of parameters useful in the drilling process. A variety of electronic components are also included in the drill string 8 for processing the data sensed by the sensors and sending the appropriate signal to the pulser unit 4. Upon the receipt of the signals, pulser unit 4 sends a pressure pulse to the surface through the downwardly flowing mud 28 in the drill pipe 2.

The pressure pulse is received and detected by bypass surface signal detector 100. Detector 100 generally includes flow constrictor 30, bypass flow lines 32, 34 and differential pressure transducer 50. As explained in more detail below, bypass flow lines 32 and 34 connect flow constrictor 30 in parallel with segment 23 of stand pipe 22 such that acoustic signals transmitted in the stand pipe 22 will also be sensed in the bypass loop 31 (FIG. 2) formed by flow constrictor 30 and bypass lines 32, 34. Transducer 50 senses the pressure pulses that are generated in the drilling mud by mud pulser 4. These pulses travel to the top of the borehole and are transmitted through mud supply line 24, stand pipe 22 and bypass loop 31 to transducer 50. Transducer 50 converts the pulses to electrical signals and transmits the signals via electrical conductor 98 to signal processing and recording apparatus 99.

Figure 2:
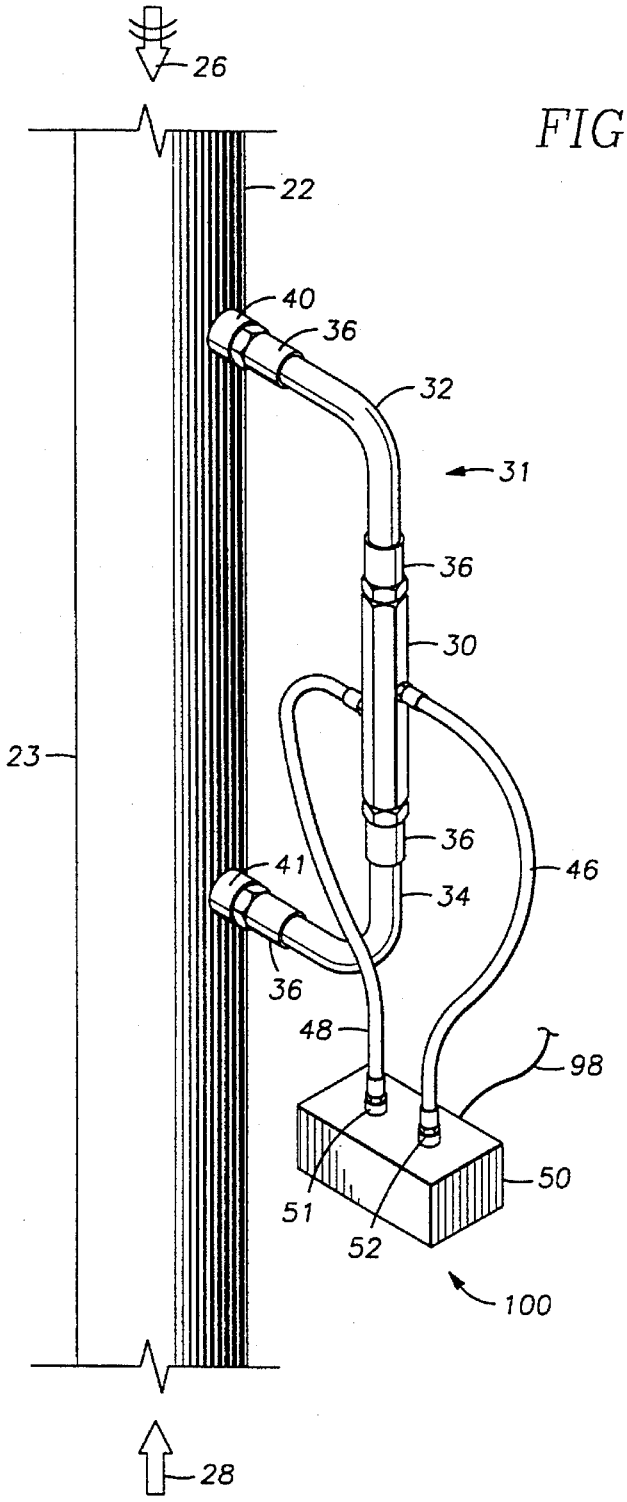
FIG. 2 is an enlarged perspective view of the detection apparatus shown in FIG. 1.

Referring now to FIG. 2, segment 23 of stand pipe 22 is shown carrying flowing drilling mud, represented by arrow 28. As previously described, stand pipe 22 also conducts the pressure pulses generated by the downhole mud pulser 4, such pressure pulses being represented by arrow 26. Mud flow 28 and pressure pulses 26 pass segment 23 of stand pipe 22 travelling in opposite directions.

Figure 3:
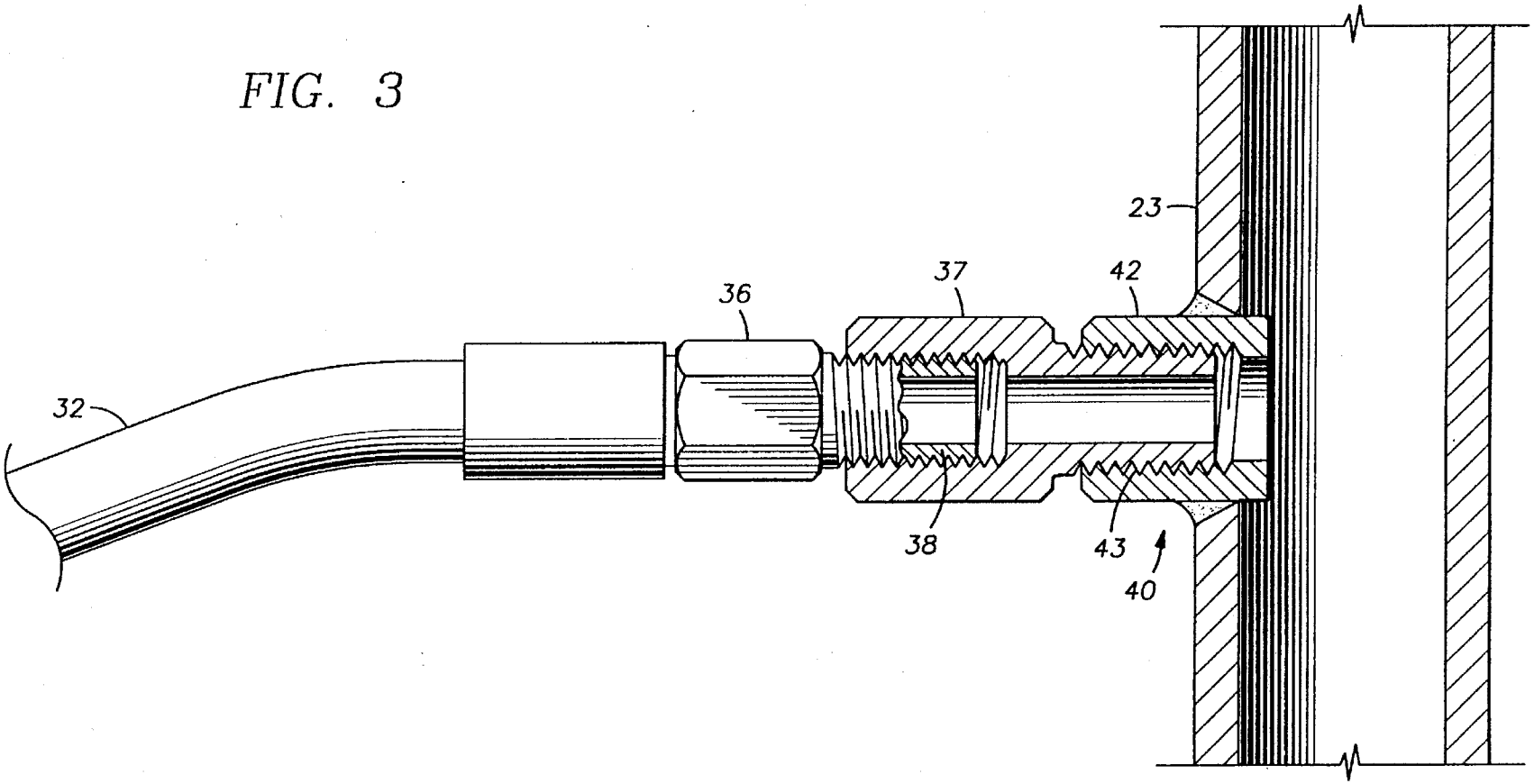
FIG. 3 is an enlarged view of a portion of the detection apparatus shown in FIG. 2.

Referring to FIGS. 2 and 3, detector 100 further includes a pair of bypass ports 40, 41. Each bypass port 40, 41 comprises a tapped access port in standpipe 22. Such ports are well known to those skilled in the art and generally include an extending collar 42 having an internally threaded portion 43 best shown in FIG. 3. Bypass ports 40, 41 may be positioned at any location in the mud supply line 24 or conduit 19 which interconnects mud pump 18 and desurger 21; however, locating ports 40, 41 in stand pipe 22 has been found successful in practicing the present invention as well as convenient, as such ports typically already exist in locations along standpipe 22 for use with conventional pressure detection apparatus.

Bypass lines 32, 34 may be connected to bypass ports 40, 41 in a number of ways known to those skilled in the art. One such connection means is shown in FIG. 3 where bypass line 32 is shown connected to bypass port 40 by means of adapter 37 and end fitting 36 which is attached to and forms the termination of line 32. As shown, threaded surface 43 of bypass port 40 threadedly receives a threaded extension of adapter 37. In a like manner, extension or stem 38 of end fitting 36 threadedly engages adapter 37. So connected, the interior passageway of bypass line 32 is thus in fluid communication with segment 23 of mud stand pipe 22, by which it is meant that mud from stand pipe segment 23 can pass into bypass line 32. Bypass line 34 may be connected to bypass port 41 in a similar manner. As well known to those skilled in the art, bypass lines 32, 34 may be interconnected with ports 40, 41 using a myriad of other fittings and adapters other than those described so as to achieve the same fluid transporting arrangement.

Figure 5:
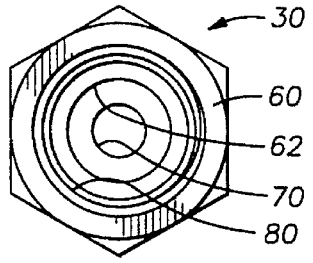
FIG. 5 is a top view of the flow constrictor shown in FIG. 3.
Figure 4:
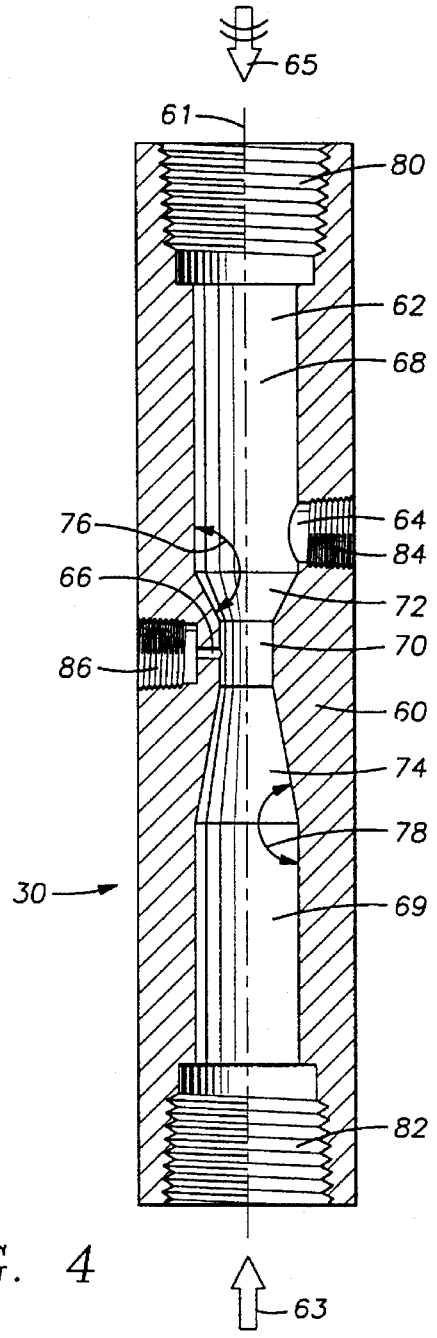
FIG. 4 is an enlarged cross sectional view of a flow constrictor which comprises a portion of the detection apparatus shown in FIG. 2.

Flow constrictor 30, best shown in FIG. 4, generally includes tubular body 60 having central longitudinal passageway or through bore 62 and a pair of radial bores 64, 66 which intersect through bore 62. It is preferred that body 60 be manufactured from stainless steel and have a hexagonal-shaped cross section as shown in FIG. 5. Through bore 62 is generally aligned with longitudinal axis 61 of constrictor 30 and includes two regions 68 and 69 having substantially identical cross sectional areas. In the preferred embodiment, bore segments 68, 69 have diameters of 0.54 inches and 0.50 inches, respectively. Disposed between regions 68 and 69 is a coaxially aligned chamber 70 having a reduced cross sectional area relative to the cross sectional areas of regions 68 and 69. Preferably, chamber 70 has a diameter approximately equal to 0.25 inches. Tapered bore segments 72, 74 interconnect chamber 70 with bore regions 68 and 69, respectively. The angle of the taper of bores 72 and 74, as represented by arrows 76 and 78, preferably are approximately equal to 150 degrees and 170 degrees, respectively. The degree of taper of bores 72, 74 may be varied from those shown and described; however, these tapers have been found to minimize the undesirable noise that may otherwise be generated by fluid turbulence inside body 60. The ends of longitudinal bore 62 include tapped counterbores 80 and 82 to allow for interconnection with bypass lines 32, 34 as shown in FIG. 2.

Referring again to FIG. 4, radial bores 64 and 66 are formed in body 60 approximately 180 degrees apart. In one preferred embodiment, radial bores 64 and 66 are formed with diameters of approximately 0.339 inches and 0.062 inches, respectively, although these diameters may be varied to accommodate various sized pressure transducers. Tapped counterbores 84 and 86 are formed in body 60 and are aligned with radial bores 64 and 66 as shown in FIG. 4.

Radial bores 64, 66 serve as pressure sensing ports as described in more detail below.

As best understood with reference to FIGS. 2 and 4, bypass loop 31 is connected in parallel with segment 23 of stand pipe 22 such that a proportionately small amount of the drilling mud flow passes through flow constrictor 30 in the direction shown by arrow 63. The mud pulse signal travels through body 60 in the opposite direction as represented by arrow 65. So connected, it is apparent that bypass lines 32, 34 must be capable of containing what is sometimes abrasive and corrosive drilling mud at relatively high pressures. Bypass lines 32 and 34 are preferably flexible hydraulic hoses having inside diameters approximately equal to ⅛ inch. A hose found to be particularly desirable in this application as bypass lines 32, 34 is hydraulic hose manufactured by The Aeroquip Industrial Division of Aeroquip Corporation in Houston, Tex. and which are capable of handling pressures of up to 3000 PSI. Bypass lines 32, 34 may be any convenient length.

While a flexible hose is preferred for bypass lines 32, 34, rigid or semi-rigid metallic conduit or tubing may alternatively be employed. However, it has been found that a flexible hose is preferred for ease of handling and installation. High pressure hydraulic hose is also inexpensive, light weight and widely available. The hose has the additional advantages that it is mechanically simple and reliable.

Bypass lines 32, 34 include end fittings 36 at each of their ends. One end fitting 36 of each bypass line 32, 34 threadedly engages tapped bores 80, 82 of flow constrictor 30. The end fitting 36 on the opposite end of bypass lines 32, 34 is connected to a bypass port 40, 41 in stand pipe 22 as previously described. So connected, it will be apparent to those skilled in the art that bypass lines 32, 34 serve to transmit the pressure pulses 26 in stand pipe 22 to the parallel-connected flow constrictor 30 via the drilling mud which fills the lines 32, 34.

Referring again to FIG. 2, differential pressure transducer 50 includes two pressure input ports 51, 52. As known in the art, differential pressure transducer 50 compares the pressures appearing at input ports 51 and 52 and generates an electrical signal corresponding to the difference in those pressures. The electrical output generated by differential transducer 50 is communicated to signal processing and recording apparatus 99 (FIG. 1) via conductor 98. Transducer 50 may be any of the conventionally known differential transducers presently used for measuring pressures in mud pulses. One transducer found to be particularly suited for the present invention is transducer model no. 1151HP manufactured by Rosemont Inc. of 12001 Technology Drive, Eden Prairie, Minn. 55344 ((612) 941-5560). While a differential transducer 50 is preferred for use with detector 100, the pressures in regions 68, 70 may instead be measured independently by discrete pressure transducers and the outputs from these transducers compared electronically by processes well known in the art.

Pressure transducer 50 is interconnected to flow constrictor 30 by pressure comparator lines 46 and 48. Lines 46 and 48 are preferably hydraulic hoses similar in structure to bypass lines 32, 34. Preferably, lines 46, 48 have inside diameters approximately equal to ⅛ inch. The ends of lines 46 and 48 include end fittings 36 such as previously described with respect to bypass lines 32, 34. Pressure comparator line 46 is connected between radial bore 64 in flow constrictor 30 and input port 52 in pressure transducer 50. Similarly, pressure comparator line 48 is connected between radial bore 66 in flow constrictor 30 and input port 51 in pressure transducer 50. During installation, air is bled from bypass lines 32, 34 and from pressure comparator lines 46, 48, and the lines are allowed to fill with drilling fluid to insure that the acoustic signals will be transmitted to flow constrictor 30, where they can be detected by pressure transducer 50.

The operation and advantages of detector 100 are best understood with reference to FIGS. 1, 2 and 4. Referring first to FIG. 1, mud pulser 4 generates acoustic signals 26 in the stream of drilling fluid contained in drill string 8. The signal is transmitted to the surface and passes through mud supply line 24 and into segment 23 of stand pipe 22, best shown in FIG. 2. The acoustic signal 26 also passes into bypass loop 31 containing flow constrictor 30. The pressure signals pass through constrictor 30 in the direction shown by arrow 65 in FIG. 4. The pressures detected in region 68 and in reduced diameter chamber 70 are transmitted to differential transducer 50 via lines 46 and 48, respectively, for comparison.

Because the flow constrictor 30 is in bypass loop 31, it is exposed to a reduced flow of drilling mud as compared to the flow in segment 23 of stand pipe 22. Consequently, the constrictor 30 is not as prone to erosion, and expensive hardfacing materials need not be applied to the body's interior surfaces. Likewise, because transducer 50 is positioned in a region of relatively stagnant drilling mud, it is similarly protected from erosion and damage.

Further, by positioning the flow constrictor outside the main mud flow path, the power requirements of the system are not increased, as might otherwise be caused by restricting the main flow path. Additionally, the flow constrictor 30 may be much smaller than would be necessary if applied in the main mud flow supply line 24. The constrictor's small size permits quick and easy installation and, if necessary, replacement. The detector 100 may be simply installed by drilling and tapping two bypass ports 40, 41 at any convenient location in the mud supply line 24 and by connecting the flow constrictor 30 to ports 40, 41 by hydraulic hoses. Installation is accomplished without cutting and removing a segment of the relatively large pipe that typically makes up the mud supply system, and without the necessity of welding components into the supply line.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus for detecting pressure pulses in a drilling fluid supply line comprising:

a drilling fluid bypass loop in parallel with a segment of the supply line;

a first region in said bypass loop having a first cross sectional area, and a second region in said loop having a second cross sectional area that is smaller than said first cross sectional area; and means for sensing the differential pressure in said first and second regions.

2. The apparatus of claim 1 wherein said bypass loop comprises a body having a through bore for passing the drilling fluid therethrough, said first and second regions forming portions of said through bore.

3. The apparatus of claim 2 wherein said sensing means comprises:

a first pressure port formed in said body and intersecting said through bore in said first region; and a second pressure port formed in said body and intersecting said through bore in said second region.

4. The apparatus of claim 3 wherein said sensing means further comprises:

a differential pressure transducer having first and second pressure input ports; and means for interconnecting said first and second pressure ports of said body to said first and second pressure input ports of said pressure transducer.

5. The apparatus of claim 2 wherein said body further comprises a tapered passageway interconnecting said first and second regions in said through bore.

6. The apparatus of claim 1 wherein said cross sectional area of said first region is at least four times as large as the cross sectional area of said second region.

7. The apparatus of claim 3 wherein:

said first pressure port comprises a first intersecting bore which intersects said through bore of said body in said first region; and wherein said second pressure port comprises a second intersecting bore which intersects said through bore of said body in said second region; and wherein the cross sectional area of said second intersecting bore is smaller than the cross sectional area of said first intersecting bore.

8. An apparatus for detecting pressure pulses in drilling fluid contained in a pipeline comprising:

a bypass loop in parallel with a segment of the pipeline;

a body in said bypass loop having a fluid passageway formed therethrough, said fluid passageway including a first region having a first cross sectional area that is smaller than the cross sectional area of the pipeline;

a constrictor in said passageway defining a region of reduced cross sectional area relative to said first region;

a first pressure tapping formed in said body and exposed to pressure in said first region;

a second pressure tapping formed in said body and exposed to pressure in said region of reduced cross sectional area;

a differential pressure transducer having input lines connected to said first and second pressure tappings;

drilling fluid contained in said input lines and said bypass loop.

9. The apparatus of claim 8 wherein said bypass loop further comprises:

first and second access ports formed in the pipeline; and flexible hoses interconnecting said body and said first and second access ports, said flexible hoses having an internal conduit having a cross sectional area less than the cross sectional area of the pipeline and greater than the cross sectional area of said passageway in said region of reduced cross sectional area.

10. The apparatus of claim 8 wherein said cross sectional area of said first region is at least four times as large as the cross sectional area of said region of reduced cross sectional area.

11. The apparatus of claim 9 wherein said passageway of said body includes a tapped counterbore on each end of said passageway for interconnection of said hoses with said passageway of said body.

12. The apparatus of claim 8 wherein said passageway of said body includes a tapered region disposed between said first region and said region of reduced cross sectional area.

13. A method for detecting pressure pulses in drilling fluid flowing in a supply line comprising the steps of:

providing a first and a second access port in the supply line;

connecting a bypass loop between said first and second access ports such that said bypass loop is in parallel with a portion of the supply line, said bypass loop having a passageway that is smaller in cross sectional area than the supply line;

providing a constriction in said passageway so as to form a region of reduced cross sectional area in said bypass loop;

substantially filling said bypass loop with a medium capable of conducting pressure pulses;

comparing the pressure in said region of reduced cross sectional area with the pressure in said passageway at a location outside said region of reduced cross sectional area.

14. An apparatus for detecting pressure pulses in a drilling fluid supply line comprising:

a first port formed in the supply line;

a second port formed in the supply line;

a bypass loop interconnecting said first and second ports, said bypass loop being in parallel with the segment of the supply line disposed between said first and second ports, said bypass loop including a region of reduced cross-sectional area, first and second pressure ports formed in said bypass loop, one of said pressure ports intersecting said region of reduced cross-sectional area; and means for detecting the fluid pressure at said first and second pressure ports in said bypass loop.

15. An apparatus for detecting pressure pulses in a drilling fluid supply line comprising:

a first port formed in the supply line;

a second port formed in the supply line;

a bypass loop interconnecting said first and second ports, said bypass loop being in parallel with the segment of the supply line disposed between said first and second ports;

first and second pressure ports formed in said bypass loop;

means for detecting the fluid pressure at said first and second pressure ports in said bypass loop;

a generally tubular body having a fluid passageway therethrough, said passageway forming a portion of said bypass loop and including a first region having a first cross-sectional area and a second region having a second cross-sectional area that is smaller than said first cross-sectional area;

wherein said first pressure port is formed in said body and intersects said fluid passageway in said first region; and wherein said second pressure port is formed in said body and intersects said fluid passageway in said second region.

16. The apparatus of claim 15 wherein said bypass loop comprises hoses interconnecting said passageway of said body with said ports and said supply line.

17. The apparatus of claim 16 wherein said body includes a tapered region disposed between said first and second regions in said passageway.

18. The apparatus of claim 16 wherein said detecting means comprises:

a differential pressure transducer having first and second pressure input ports; and means for interconnecting said first and second pressure ports of said body to first and second pressure input ports of said pressure transducer.

* * * * *